United States Patent [19]

Richards et al.

[11] Patent Number: 5,037,685

[45] Date of Patent: Aug. 6, 1991

[54] VINYL SHINGLE ROOFING PRODUCT

[75] Inventors: Wilber T. Richards, Wilmington; Edward D. Richards, Carolina Beach, both of N.C.

[73] Assignee: Kenneth R. O'Leary, Sr., Charlotte, N.C. ; a part interest

[21] Appl. No.: 441,366

[22] Filed: Nov. 27, 1989

[51] Int. Cl.[5] ..... B32B 3/06; B32B 3/08; B32B 3/10; B32B 7/06

[52] U.S. Cl. ..... 428/40; 428/136; 428/192; 428/347; 428/489; 428/906; 52/518; 52/549

[58] Field of Search ..... 52/518, 543, 549, 552; 428/40, 136, 192, 489, 906, 347

[56] References Cited

U.S. PATENT DOCUMENTS

| | | | |
|---|---|---|---|
| 3,082,577 | 3/1963 | Fasold et al. | 52/543 |
| 3,903,340 | 9/1975 | Shepherd | 52/518 |
| 4,546,589 | 10/1985 | Seaman | 52/518 |

*Primary Examiner*—Alexander S. Thomas
*Attorney, Agent, or Firm*—Ralph H. Dougherty

[57] ABSTRACT

An improved elongated vinyl roofing shingle material, for installation on pitched roofs, is provided in coils or rolls, the length of each coil being longer than the width of a roof, the resulting roof having no vertical seams. The elongated shingles have pre-formed, longitudinally-aligned, elongated holes for accommodating roofing nails and to allow for expansion and contraction of the elongated shingle material without buckling or bowing the material. A longitudinal adhesive strip on the shingle upper side is spaced from the pre-formed fastener holes. The method of installation is also disclosed.

15 Claims, 3 Drawing Sheets

VINYL SHINGLE ROOFING PRODUCT

BACKGROUND OF THE INVENTION

1. Field of the Invention

The present invention relates to roofing of structures, and more particularly to a vinyl shingle roof covering product for installation on pitched roofs, and an improved method for roof covering installation.

2. Description of the Prior Art

Roofing is an ancient art. Through the ages roofers have used a variety of materials to shield roofed structures from the environment, including, but not limited to, thatch, asphalt, asbestos, slate, wood, and clay tile.

Conventional roofing materials suffer from a number of disadvantages. Asphalt and asbestos, for example, are both very heavy and brittle materials with a typical useful life of approximately 15 to 25 years. As these materials approach the end of their useful lives, they deteriorate in both appearance and function. Asbestos has been found to be an environmentally unsafe material, and is rarely used in roofing today. Clay and slate roofing material are also both heavy and brittle, and require a sturdy roof foundation to hold them in position. In addition, damaged clay or slate roofs are very difficult to repair. Finally, wood and thatch roofs suffer a serious disadvantage since neither is fire resistant. Certain shingles, such as asphalt shingles and wooden shakes, readily retain dirt and promote the formation of mildew under them.

The weight of roofing materials is important from several perspectives. First, the heavier the material, the higher the manufacturing and handling costs associated with production and shipping and distribution costs of the end product. Second, in order to accomplish their task, roofers must transfer roofing materials from the ground to the roof surface. Clearly, more effort, time, and expense is associated with transferring a heavy load than a light load. One of the most common roofing materials in use today is asphaltic shingle, which is provided in bundles. To install them, a roofer carries several bundles up a ladder and scatters them about the roof, then breaks each bundle open as needed. Asphalt is a very heavy material, and the granular wear surface on the shingle adds a considerable amount of weight.

The useful life of presently available asphalt shingle roofs is from 15 to 20 years. Roof guarantees are usually given for only 15 years.

Applicants are aware of the following U.S. Pat. Nos. concerning roofing materials and systems.

| U.S. PAT. NO. | INVENTOR | ISSUE DATE | TITLE |
|---|---|---|---|
| 3,605,369 | Merrill | Sept. 20, 1971 | WOOD SIMULATING SHINGLE |
| 3,619,343 | Freeman | Nov. 9, 1971 | ROOFING MATERIAL |
| 4,040,211 | Wotherspoon | Aug. 9, 1977 | MULTI PORTION TILE HAVING A CURLED INTERLOCK |
| 4,274,236 | Kessler | June 23, 1981 | HIGH STIFFNESS CELLULAR PLASTIC SIDING |
| 4,279,106 | Gleason | July 21, 1981 | ROOFING PANEL |
| 4,546,589 | Seaman | Oct. 15, 1989 | SINGLE-PLY SEALED MEMBRANE ROOFING SYSTEM |

The Seaman Patent teaches a single ply roof system for a flat roof, or "roof deck". The roofing is produced in rolls, applied from rolls, and held in place by nails along its edges. The edges of the sheets are heat bonded slightly overlapped, then they are heat bonded.

Merrill teaches a simulated shingle composed of a foam in a metal shell.

Kessler teaches a plastic siding also made of foam or PVC, which has reinforcing ribs on its underside.

Freeman teaches an expanded open-cell plastic roofing material, such as polyolefin foam, in which a single sheet covers the entire roof, but which requires an additional overlay material for sufficient protection from the elements.

Wotherspoon teaches simulated tiles with interlocking means which are quite complex, as best seen in his FIG. 4.

Gleason teaches a stiff roof panel in which the basic shell of hard plastic is filled with polyurethane foam.

SUMMARY OF THE INVENTION

The invention provides an improved roofing shingle for installation on pitched roofs, the shingle preferably being a vinyl material of sufficient length that there is no seam when installed on a roof. Pre-formed, longitudinally-aligned, elongated holes accommodate roofing nails and allow for expansion and contraction of the elongated shingle material without causing the material to buckle or bow. The shingle material is provided in a coil for ease of handling and shipping of long lengths. The coil may be held by a mandrel on a roll stand for handling of extremely long lengths. The shingle coils are provided in any desired length, generally of at least 100 feet, so that there will be absolutely no vertical seams in a roof. The shingle is installed from the coil, a single shingle extending completely across the width of the roof, and replacing a full course of shingles.

Vinyl siding has been known and used for many years, but vinyl shingles for roofing have been heretofore unknown. Vinyl siding is usually a composite, including a backing material for support, so the vinyl will not sag or assume the configuration of the underlying material during hot weather. This is not a consideration in vinyl roof shingles, and no backing is required.

OBJECTS OF THE INVENTION

The principal object of the invention is to provide an improved roofing product.

A further object of this invention is to provide a roofing product for extending the useful life of a roof to approximately 50 to 75 years.

Another object of the invention is to produce a roofing product that is resistant both to direct physical impact, from such items as hail and tree limbs, and to wind impact.

Another object of the invention is to produce a roofing material that is sufficiently flexible to permit rolling of the material into an easily carried burden.

It is also an object of the invention to provide a roofing material that is washable and thereby easily cleaned.

Another object of the invention is to provide a roofing material that is lightweight.

A further object of the invention is to provide a roofing material that is durable.

Another object of the invention is to provide a roofing material that is fire retardant.

It is also an object of the invention to provide a roofing material that is capable of being manufactured in a variety of colors.

It is also an object of the invention to provide a roofing material that is capable of being manufactured in a variety of patterns.

It is also an object of the invention to provide a roofing material that is capable of being installed in long lengths without buckling or developing bows.

It is another object of the invention to provide a method for installing a pitched roof covering.

BRIEF DESCRIPTION OF THE DRAWINGS

The foregoing and other objects will become more readily apparent by referring to the following detailed description and the appended drawings in which.

DETAILED DESCRIPTION

Figure 1:
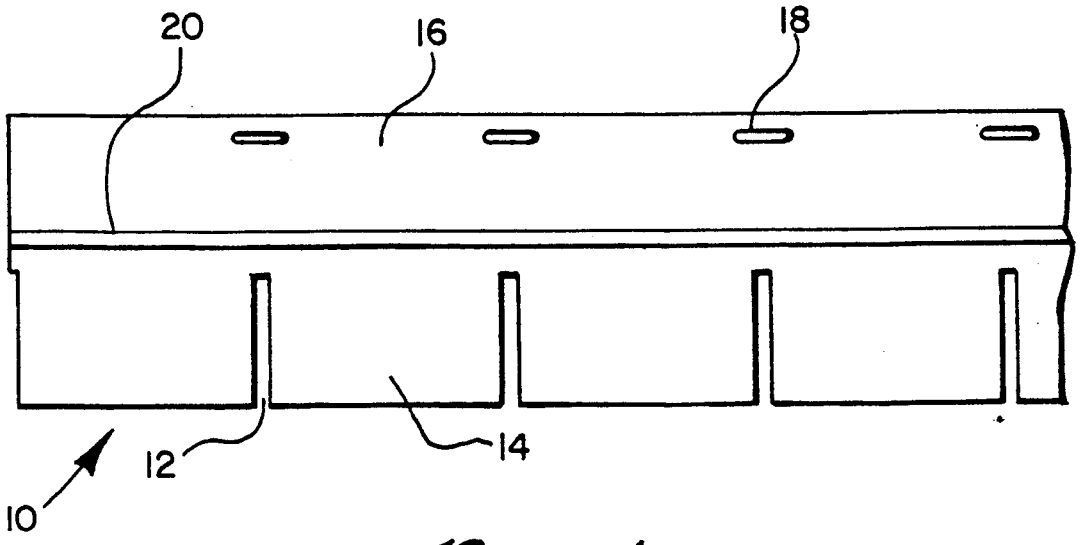
FIG. 1 is a top view of a portion of a shingle according to the present invention.
Figure 2:
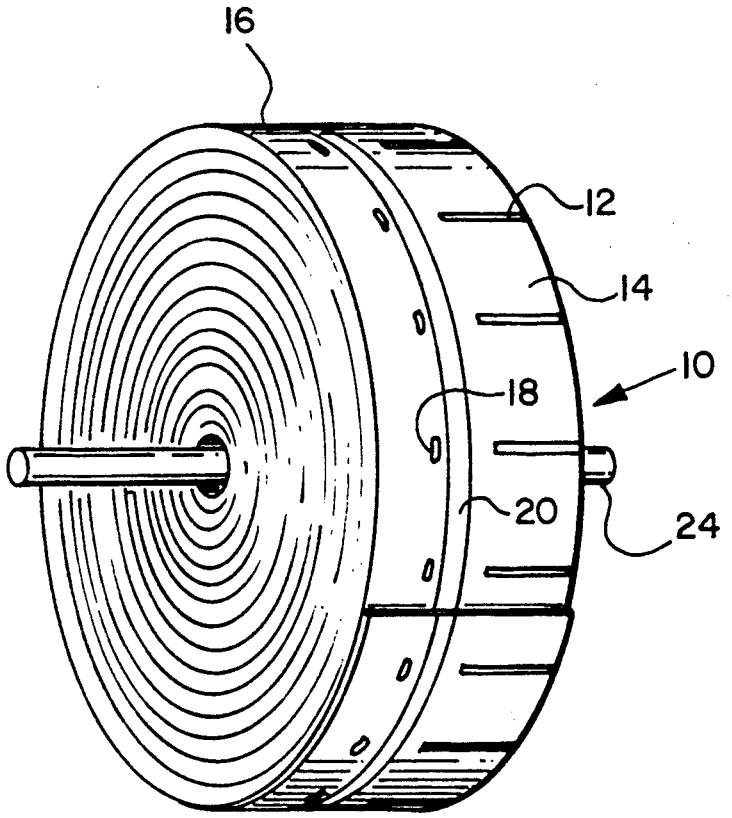
FIG. 2 is an isometric view of a roll of shingle material on a mandrel in accordance with the present invention.

Referring now to the drawings, and particularly to FIG. 1, the invented roofing material is an elongated shingle 10, which includes shingle slots 12 cut in one side of the elongated shingle to form flaps 14. The uncut top portion 16 of the shingle is provided with elongated pre-formed holes 18 to accommodate fasteners, not shown, such as nails, screws, or roofing tacks. A central, longitudinally-oriented adhesive strip 20 is provided on the upper side of the elongated shingle, that is, on the side which will be the upper or top side upon installation. The pre-formed holes 18 may be provided adjacent the adhesive strip 20, as shown in FIG. 2, but preferably are spaced from the adhesive strip, as shown in FIG. 1. The preferred dimensions of the invented shingle are 12 inches in height, with shingle slots 12 being one-half inch wide and 5 inches deep.

Figure 4:
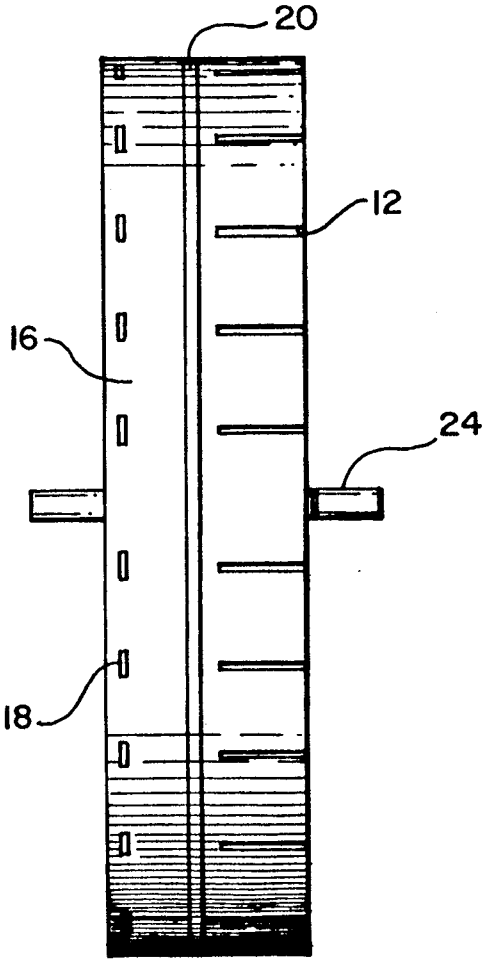
FIG. 4 is an elevation view of the roll of shingle material of FIG. 2.
Figure 3:
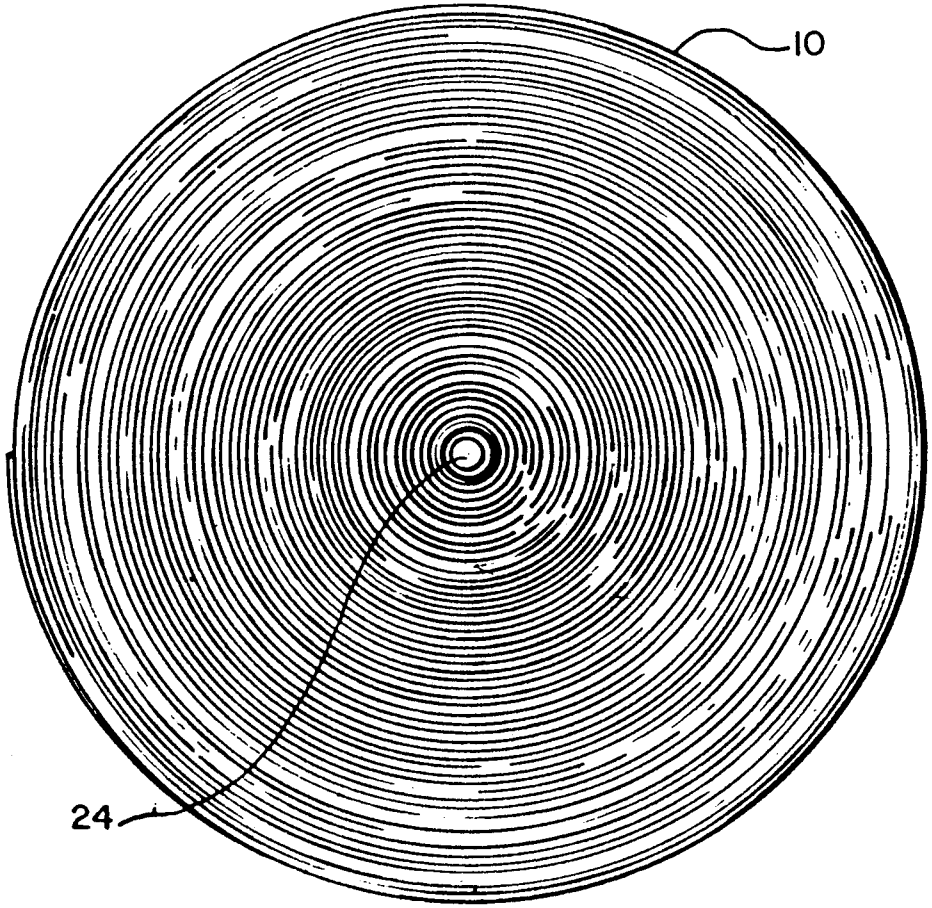
FIG. 3 is a left side view of the roll of shingle material of FIG. 2.

The extremely long length of roofing material 10 is rolled to form a coil of roofing on a mandrel 24 as shown in FIGS. 2, 3, and 4.

The preferred material for the elongated roofing shingle is vinyl or vinyl plastic, which is capable of incorporation of pigments therein to provide any desired roof color. Vinyl is lightweight, durable, fire retardant, and capable of being manufactured in a variety of colors and a variety of patterns. Vinyl has a useful life under weathering conditions of approximately 50 to 75 years, is flexible, and resistant both to direct physical impact, from such items as hail and tree limbs, and to wind impact.

The rolled roof shingle is manufactured by molding. The molding process includes formation of the elongated nail slots and the shingle slots, as well as creation of a desired pattern into the face that will be exposed after installation. After molding is completed, adhesive is placed longitudinally along the center of the upper side, i.e., the side with a pattern molded thereon. If necessary, or desired, a lightweight protective shield or covering is placed on the underside of the shingle, directly under and aligned with the adhesive strip. Then the elongated roofing is coiled to form the finished product for the roofing and construction industries. The shield is preferably tape having adhesive on the side against the shingle, and a non-adhesive surface on the other side, such as a waxy surface, which will avoid adhering to the overlaying adhesive from the next turn of the shingle in the coil.

Any heat reactive adhesive which sets upon attaining a temperature of about 100° F. is a suitable adhesive for this invention. This temperature can easily be reached on most days of the year merely by the impact of direct sunlight onto the roof. Resin-based adhesives or even tar are suitable to utilize for this purpose. Alternatively, an adhesive can be employed which tacks immediately, in which case a waxed paper or other shielding membrane, such as thin plastic, can be placed over the sticky adhesive and removed while unrolling or while placing the elongated shingle in position for nailing.

Tests have been made of molded vinyl roofing material under conditions of heat and cold.

In the heat test, a sample of the invented molded vinyl roof was held at 250° F. for a period of 2 hours. Although the sample became soft, it held its form and strength.

In the cold test, the invented material was held at −20° F. for 4 hours. The cold material was not brittle, did not break or crack, and upon twisting and pulling, it did not tear.

The invented roofing material has been found resistant to tearing, and thus should provide strength to hold in high winds, including hurricane force winds of about 100 miles per hour.

Figure 5:
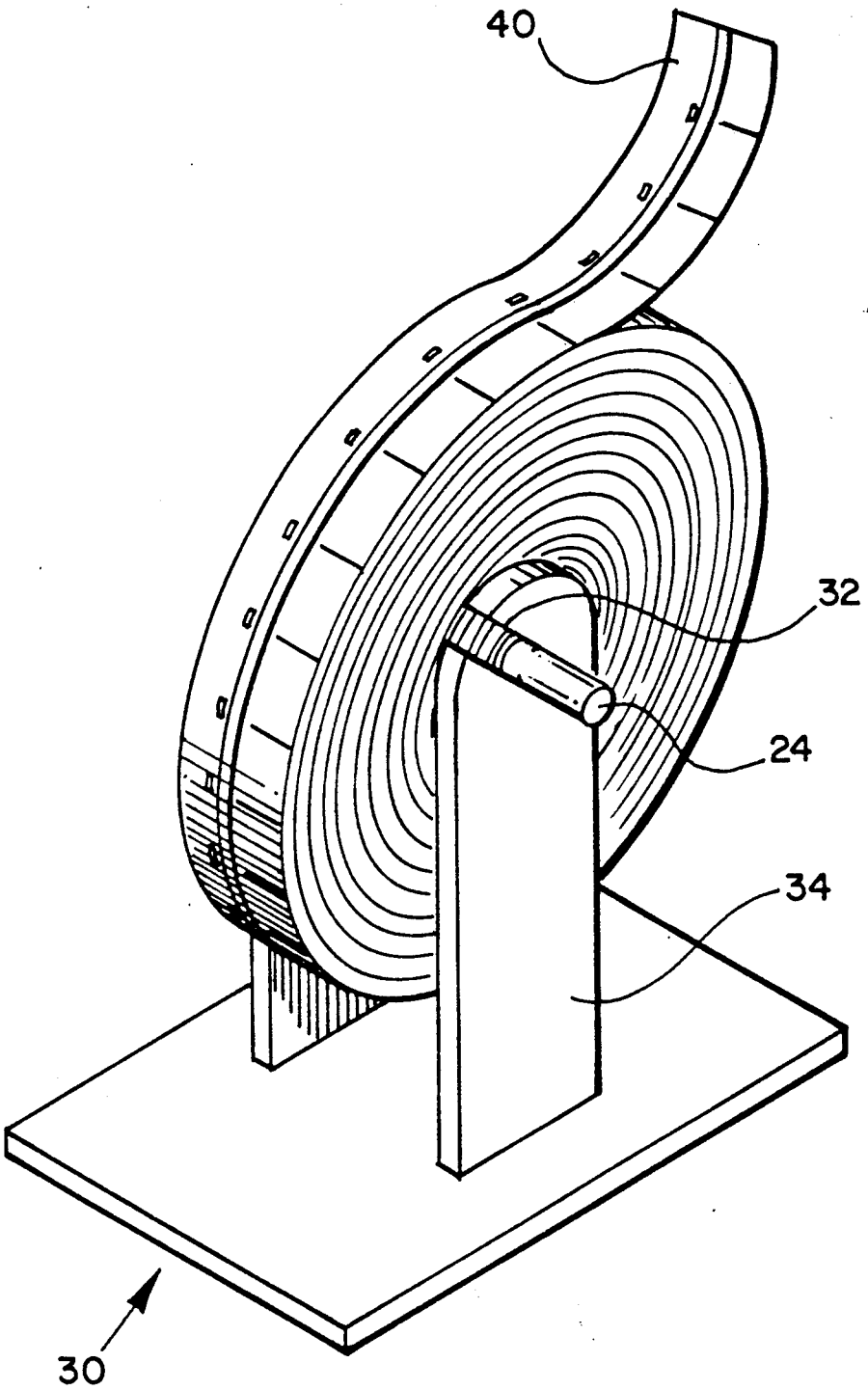
FIG. 5 is an isometric view of a roll stand with a roll of shingle material thereon, in accordance with the present invention.

As shown in FIG. 5, a coil of elongated shingle 10 on a mandrel 24 is placed on a stand 30. The mandrel engages slots 32 in upright supports 34. The slots 32 are shown positioned at an angle to prevent lifting of the mandrel 24 from the supports upon pulling of the shingle from the coil. Any type of mandrel retaining or locking device can be utilized for this purpose.

In operation, the roofer pulls the free end 40 of the elongated shingle 10 onto a roof, and stretches it across the full width of the roof with the adhesive side up. Mechanical fasteners, such as nails or screws are placed generally in the center of each preformed elongated nail hole 18, to allow for expansion and contraction without causing the shingle to buckle or bow. If necessary, the shingle 10 is cut or trimmed at the end to accommodate the shingle to the exact width of the roof. If the adhesive 20 is shielded by tape on the underside, the shielding material need not be removed for shingle installation. If the adhesive 20 is shielded by other shielding material, the shielding material is removed upon unrolling the coil, or immediately before nailing, as desired. The roof is completed by adding additional courses in the same manner, centering the shingle slots of the next higher course between the shingle slots of the next lower course in a known manner. Small amounts of trimming may be required at one or both ends of a shingle course. The shingle, however, is laid with no vertical seams, unlike present roof shingling practice, as one length of the invented shingle equals one full course of prior art shingles.

What is claimed is:

1. A roof covering material, comprising:

an elongated strip of weather resistant vinyl material having a face side and an underside;

said strip being provided with equally spaced transverse shingle slots in one longitudinal edge thereof;

said strip being provided with longitudinally aligned, longitudinally spaced, longitudinally elongated preformed holes distributed along the length of said strip, each elongated hole being adapted for receiving a fastener therethrough; and adhesive means distributed longitudinally along the center of the strip upper side.

2. A roof covering material according to claim 1, wherein the length of said strip is adapted for placement on any width roof as a full course of shingles.

3. A roof covering material according to claim 1, wherein said strip is formed into a coil.

4. A roof covering material according to claim 3, wherein said strip is coiled onto a mandrel.

5. A roof covering material according to claim 4, further comprising means for supporting said coil in position for pulling elongated shingle from said coil in a substantially straight line.

6. A roof covering material according to claim 1, wherein the weather resistant vinyl material has pigment incorporated therein, whereby the vinyl has a desired color.

7. A roof covering material according to claim 1, further comprising a patterned surface molded on the face side thereof.

8. A roof covering material according to claim 1, further comprising mechanical fasteners inserted through said elongated preformed holes along the length of said strip for affixing said strip to a roof.

9. A roof covering material according to claim 6, wherein said fasteners are nails.

10. A roof covering material according to claim 6, wherein said fasteners are screws.

11. A roof covering material according to claim 1, wherein said adhesive is a heat reactive adhesive which sets upon attaining a temperature of about 100° F.

12. A roof covering material according to claim 1, wherein said adhesive has a resin base.

13. A roof covering material according to claim 1, further comprising an elongated strip of adhesive shielding membrane material covering said adhesive.

14. A roof covering material according to claim 13, wherein said elongated strip of adhesive shielding material covering said adhesive is selected from the group comprising waxed paper and thin plastic.

15. A roof covering material according to claim 1, further comprising an elongated strip of non-adhesive shielding membrane material affixed to the underside of said elongated strip, and adapted to contact said adhesive in a non-adhesive manner when coiled.

* * * * *